US006969309B2

(12) United States Patent
Carpenter

(10) Patent No.: US 6,969,309 B2
(45) Date of Patent: Nov. 29, 2005

(54) MICROELECTRONIC SUBSTRATE ASSEMBLY PLANARIZING MACHINES AND METHODS OF MECHANICAL AND CHEMICAL-MECHANICAL PLANARIZATION OF MICROELECTRONIC SUBSTRATE ASSEMBLIES

(75) Inventor: Craig M. Carpenter, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/812,804

(22) Filed: Mar. 29, 2004

(65) Prior Publication Data

US 2004/0192177 A1 Sep. 30, 2004

Related U.S. Application Data

(60) Continuation of application No. 09/687,209, filed on Oct. 13, 2000, now Pat. No. 6,736,708, which is a division of application No. 09/145,400, filed on Sep. 1, 1998, now Pat. No. 6,439,967.

(51) Int. Cl.[7] ..... B24B 49/00
(52) U.S. Cl. ..... 451/285; 451/287
(58) Field of Search ..... 451/285–289, 451/303, 307, 41, 490

(56) References Cited

U.S. PATENT DOCUMENTS

| | | | | |
|---|---|---|---|---|
| 2,189,472 A | | 2/1940 | Peterson | |
| 2,225,073 A | | 12/1940 | Miller | |
| 3,178,863 A | | 4/1965 | Mikiya | |
| 3,319,686 A | | 5/1967 | Prevette | |
| 3,424,505 A | | 1/1969 | Pizzitola | |
| 3,496,685 A | | 2/1970 | Schmidt et al. | |
| 4,925,055 A | | 5/1990 | Robbins, III et al. | |
| 5,016,400 A | | 5/1991 | Weber | |
| 5,114,244 A | | 5/1992 | Dunham et al. | |
| 5,230,184 A | | 7/1993 | Bukhman | |
| 5,246,761 A | | 9/1993 | Sasaki | |
| 5,257,478 A | * | 11/1993 | Hyde et al. | 451/287 |
| 5,351,447 A | | 10/1994 | Grauert | |
| 5,554,064 A | | 9/1996 | Breivogel et al. | |
| 5,558,568 A | | 9/1996 | Talieh et al. | |
| 5,593,344 A | | 1/1997 | Weldon et al. | |
| 5,664,989 A | | 9/1997 | Nakata et al. | |
| 5,672,096 A | | 9/1997 | Amarosa, Sr. et al. | |
| 5,679,063 A | | 10/1997 | Kimura et al. | |
| 5,762,546 A | | 6/1998 | James et al. | |
| 5,779,521 A | | 7/1998 | Muroyama et al. | |
| 5,800,248 A | | 9/1998 | Pant et al. | |
| 5,816,900 A | * | 10/1998 | Nagahara et al. | 451/285 |
| 5,827,112 A | | 10/1998 | Ball | |
| 5,860,851 A | | 1/1999 | Beppu et al. | |
| 5,868,605 A | | 2/1999 | Cesna | |
| 5,931,719 A | | 8/1999 | Nagahara et al. | |
| 5,938,507 A | | 8/1999 | Ko et al. | |

(Continued)

*Primary Examiner*—Hadi Shakeri
(74) *Attorney, Agent, or Firm*—Dorsey & Whitney LLP

(57) ABSTRACT

Planarizing machines for chemical-mechanical planarization of microelectronic substrate assemblies are disclosed. The planarizing machines for processing microelectronic substrate assemblies generally include a table, a pad support assembly either positioned on or in the table, and a planarizing medium coupled to the pad support assembly. The pad support assembly includes a fluid container and an elastic membrane coupled to the fluid container. The fluid container generally is a basin that is either a separate component that is attached to the table, or a depression in the table itself. The fluid container can also be a bladder attached to the table. The fluid chamber is filled with support fluid to support the elastic membrane over the fluid chamber.

20 Claims, 9 Drawing Sheets

U.S. PATENT DOCUMENTS 5,961,373 A 10/1999 Lai et al.
5,975,994 A 11/1999 Sandhu et al.
5,980,368 A 11/1999 Chang et al.
5,997,385 A 12/1999 Nishio
6,042,457 A 3/2000 Wilson et al.
6,062,959 A 5/2000 Weldon et al.
6,095,908 A 8/2000 Torii
6,126,527 A 10/2000 Kao et al.
6,139,428 A 10/2000 Drill et al.
6,142,857 A 11/2000 Cesna

* cited by examiner

MICROELECTRONIC SUBSTRATE ASSEMBLY PLANARIZING MACHINES AND METHODS OF MECHANICAL AND CHEMICAL-MECHANICAL PLANARIZATION OF MICROELECTRONIC SUBSTRATE ASSEMBLIES

CROSS-REFERENCE TO RELATED APPLICATIONS

This application is a continuation of U.S. patent application Ser. No. 09/687,209, filed Oct. 13, 2000, now U.S. Pat. No. 6,736,708, which is a divisional of U.S. patent application Ser. No. 09/145,400, filed Sep. 1, 1998, U.S. Pat. No. 6,439,967.

TECHNICAL FIELD

The present invention relates to planarizing machines for microelectronic substrate assemblies, and methods of mechanical and chemical-mechanical planarization of microelectronic substrate assemblies.

BACKGROUND OF THE INVENTION

Mechanical and chemical-mechanical planarizing processes (collectively "CMP") are used in the manufacturing of microelectronic devices for forming a flat surface on semiconductor wafers, field emission displays (FEDs) and many other types of microelectronic substrate assemblies. FIG. 1 schematically illustrates a planarizing machine 10 with a platen or table 20, a carrier assembly 30, a polishing pad 40, and a planarizing fluid 44 on the polishing pad 40. The planarizing machine 10 may also have an under-pad 25 attached to an upper surface 22 of the platen 20 for supporting the polishing pad 40. In many planarizing machines, a drive assembly 26 rotates (arrow A) and/or reciprocates (arrow B) the platen 20 to move the polishing pad 40 during planarization.

The carrier assembly 30 controls and protects a substrate 12 during planarization. The carrier assembly 30 typically has a substrate holder 32 with a backing pad 34 that holds the substrate 12 via suction, and a drive assembly 36 of the carrier assembly 30 typically rotates and/or translates the substrate holder 32 (arrows C and D, respectively). The substrate holder 32, however, may be a weighted, free-floating disk (not shown) that slides over the polishing pad 40.

The combination of the polishing pad 40 and the planarizing fluid 44 generally define a planarizing environment that mechanically and/or chemically-mechanically removes material from the surface of the substrate 12. The polishing pad 40 may be a conventional polishing pad composed of a polymeric material (e.g., polyurethane) without abrasive particles, or it may be an abrasive polishing pad with abrasive particles fixedly bonded to a suspension material. In a typical application, the planarizing fluid 44 may be a CMP slurry with abrasive particles and chemicals for use with a conventional nonabrasive polishing pad. In other applications, the planarizing fluid 44 may be a chemical solution without abrasive particles for use with an abrasive polishing pad.

To planarize the substrate 12 with the planarizing machine 10, the carrier assembly 30 presses the substrate 12 against a planarizing surface 42 of the polishing pad 40 in the presence of the planarizing fluid 44. The platen 20 and/or the substrate holder 32 then move relative to one another to translate the substrate 12 across the planarizing surface 42. As a result, the abrasive particles and/or the chemicals in the planarizing medium remove material from the surface of the substrate 12.

CMP processing is particularly useful in fabricating FEDs, which are one type of flat panel display in use or proposed for use in computers, television sets, camcorder viewfinders, and a variety of other applications. FEDs have a base plate with a generally planar emitter substrate juxtaposed to a faceplate. FIG. 2 illustrates a portion of a conventional FED base plate 120 with a glass substrate 122, an emitter layer 130, and a number of emitters 132 formed on the emitter layer 130. An insulator layer 140 made from a dielectric material is disposed on the emitter layer 130, and an extraction grid 150 made from polysilicon or a metal is disposed on the insulator layer 140. A number of cavities 142 extend through the insulator layer 140, and a number of holes 152 extend through the extraction grid 150. The cavities 142 and the holes 152 are aligned with the emitters 132 to open the emitters 132 to the faceplate (not shown).

Referring to FIGS. 2 and 3, the emitters 132 are grouped into discrete emitter sets 133 in which the bases of the emitters 132 in each set are commonly connected. As shown in FIG. 3, for example, the emitter sets 133 are configured into columns (e.g., $C_1$–$C_2$) in which the individual emitter sets 133 in each column are commonly connected by a high-speed column interconnect 170. Additionally, each emitter set 133 is proximate to a grid structure super adjacent to the emitters that is configured into rows (e.g., $R_1$–$R_3$) in which the individual grid structures are commonly connected in each row by a high-speed row interconnect 160. The row interconnects 160 are generally formed on top of the extraction grid 150, and the column interconnects 170 are formed under the extraction grid 150 on top of the emitter layer 130. It will be appreciated that the column and row assignments were chosen for illustrative purposes.

One concern in manufacturing FEDs is that emitters in the center of the base plate may be damaged during CMP processing because FED base plates generally have a significant curvature or bow that makes it difficult to uniformly remove material from the base plates. In a typical process for fabricating the base plate 120 shown in FIG. 2, a number of conformal layers are initially deposited over the emitters 132, and then the substrate assembly is planarized. For example, a conformal dielectric layer is initially deposited over the emitter layer 130 and the emitters 132 to provide material for the insulator layer 140. A conformal polysilicon or amorphous silicon layer is then deposited on the insulator layer 140 to provide material for the extraction grid 150, and a conformal metal layer is deposited over the grid layer to provide material for the row interconnects 160. The internal stresses in the insulator layer 140 and the extraction grid layer 150 generally cause the base plate 120 to have a convex "bow" so that the center of the base plate 120 has a downward curvature when it is mounted to the substrate holder of the planarizing machine.

After all of the conformal layers are deposited, the base plate sub-assembly 120 is planarized by CMP processing to form a planar surface at an elevation just above the tips of the emitters 132. CMP processing, however, may remove much more material from the center of the base plate 120 than the perimeter regions because the FED base plate 120 may have a downward curvature in the substrate carrier. As a result, CMP processing may either severely damage the extraction grid and the emitter sets at the center of FED base plates, or it may not remove enough material to expose the extraction grid and the emitter sets at the perimeter regions.

The failure to accurately form the emitter sets and the extraction grid across the whole surface of the FED base plate will cause black or gray spots on the resulting FED face plate where pixels are not illuminated. Thus, CMP processing can destroy a whole FED even though only a small fraction of the extraction grid and emitter sets are inoperable.

Another manufacturing concern of CMP processing is that there is a significant drive to fabricate semiconductor devices on large wafers to increase the yield of IC-device fabrication, and to develop large FEDs that can be used in computers, televisions and other large scale applications. The destruction of IC-devices or emitter sets during CMP processing, however, is particularly problematic for applications using twelve-inch diameter or larger substrates because the film stresses exacerbate bowing in larger substrates. For example, because the bow in a base plate with a sixteen-inch diagonal measurement is generally about 150 $\mu$m and the emitters have a height of only about 1.0–2.0 $\mu$m, CMP processing can easily damage or destroy a large number of emitters at the center of the substrate. It will be appreciated that similar results occur to IC-devices in the center of twelve-inch diameter substrates. Thus, CMP processes are currently impeding progress in cost-effectively manufacturing large FEDs or semiconductor devices on large microelectronic substrates.

SUMMARY OF THE INVENTION

The present invention is directed toward planarizing machines for microelectronic substrate assemblies, and methods of mechanical and chemical-mechanical planarization of microelectronic substrate assemblies. The planarizing machines for processing microelectronic substrate assemblies generally include a table, a pad support assembly either positioned on or in the table, and a planarizing medium coupled to the pad support assembly. In one aspect of the invention, the pad support assembly includes a fluid container and an elastic membrane coupled to the fluid container. The fluid container is generally a basin that is either an independent component separately attached to the table, or it is a depression in the table itself. The fluid container can also be a bladder attached to the table. The membrane generally has a first surface engaging a portion of the fluid container to define a fluid chamber or cavity, and the membrane has a second surface to which the planarizing medium is attached. The planarizing medium has a planarizing surface facing away from the elastic membrane and an under surface coupled to the second surface of the membrane. For example, the planarizing medium can be a polishing pad and the under surface can be a backside of the polishing pad attached directly to the second surface of the membrane. The planarizing medium can alternatively be a polishing pad attached to an under-pad in which the under surface is a backside of the under-pad that is attached directly to the second surface of the membrane. The fluid chamber is filled with a support fluid to support the elastic membrane over the fluid chamber. The support fluid can be water, glycerin, air, or other suitable fluids that support the elastic membrane in a manner that allows both the membrane and the planarizing medium to flex inward toward the fluid chamber under the influence of a mechanical force.

In operation, a substrate carrier assembly presses a microelectronic substrate assembly against a planarizing surface of the planarizing medium, and at least one of the substrate carrier assembly or the planarizing medium moves to translate the substrate assembly across the planarizing surface. As the microelectronic substrate moves across the planarizing surface, both the planarizing surface and the under surface of the planarizing medium flex with the elastic membrane toward the fluid chamber to conform to a curvature of the microelectronic substrate assembly. More specifically, the planarizing medium and the membrane flex at a local flex zone under the substrate during planarization to provide at least a substantially uniform distribution of pressure across the substrate.

DETAILED DESCRIPTION OF THE INVENTION

The present invention is directed toward planarizing machines and methods for mechanical and/or chemical-mechanical planarizing of microelectronic substrate assemblies. Many specific details of certain embodiments of the invention are set forth in the following description, and in FIGS. 4–10, to provide a thorough understanding of such embodiments. One skilled in the art, however, will understand that the present invention may have additional embodiments, or that the invention may be practiced without several of the details described in the following description.

Figure 1:
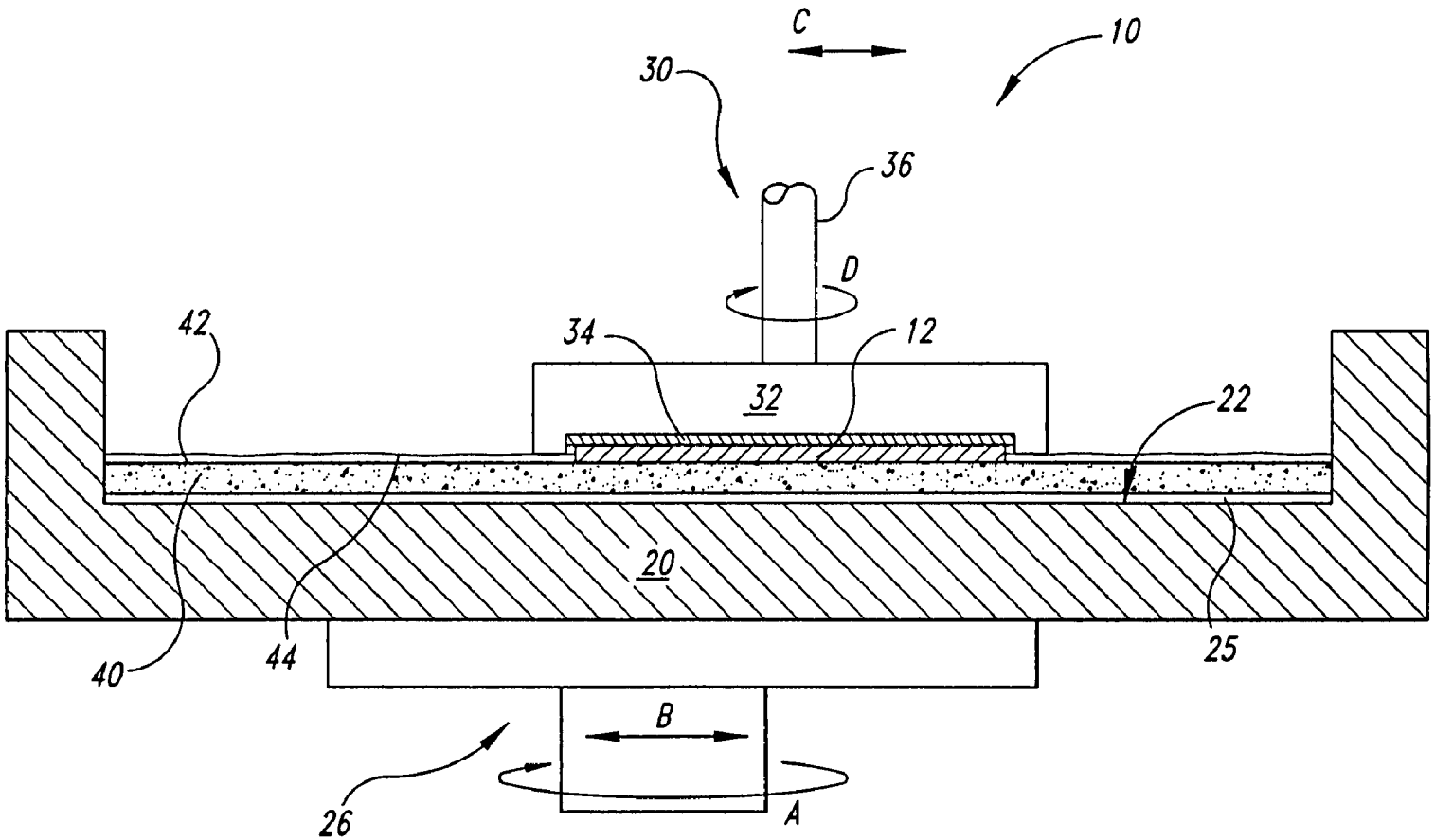
Fig. 1 (Prior Art)
FIG. 1 is a schematic cross-sectional view illustrating a planarizing machine in accordance with the prior art.
Figure 2:
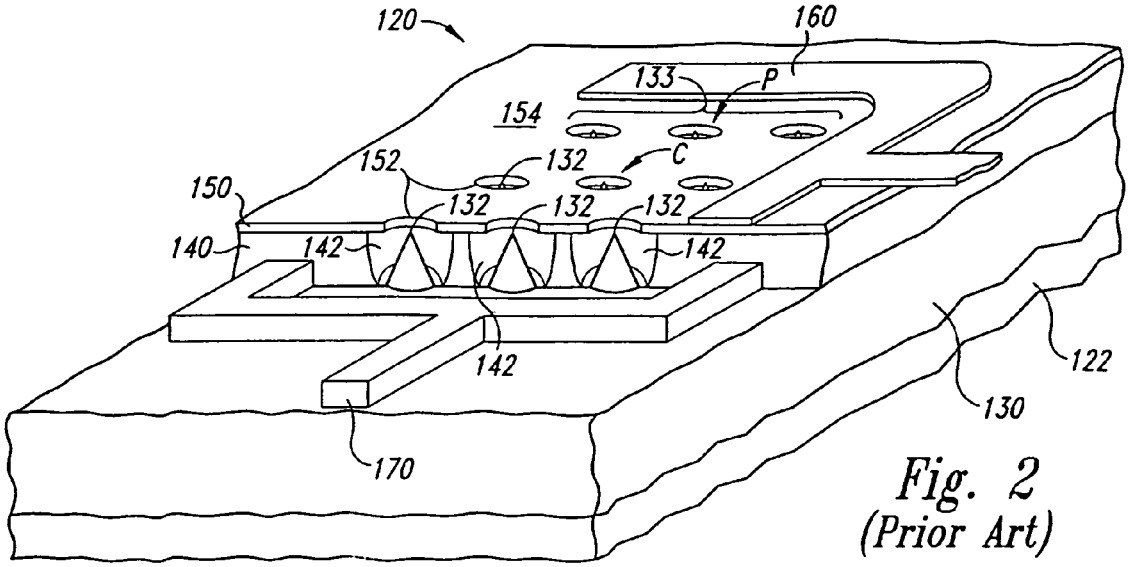
Fig. 2 (Prior Art)
FIG. 2 is a partial isometric view of a base plate of a field emission display in accordance with the prior art.
Figure 3:
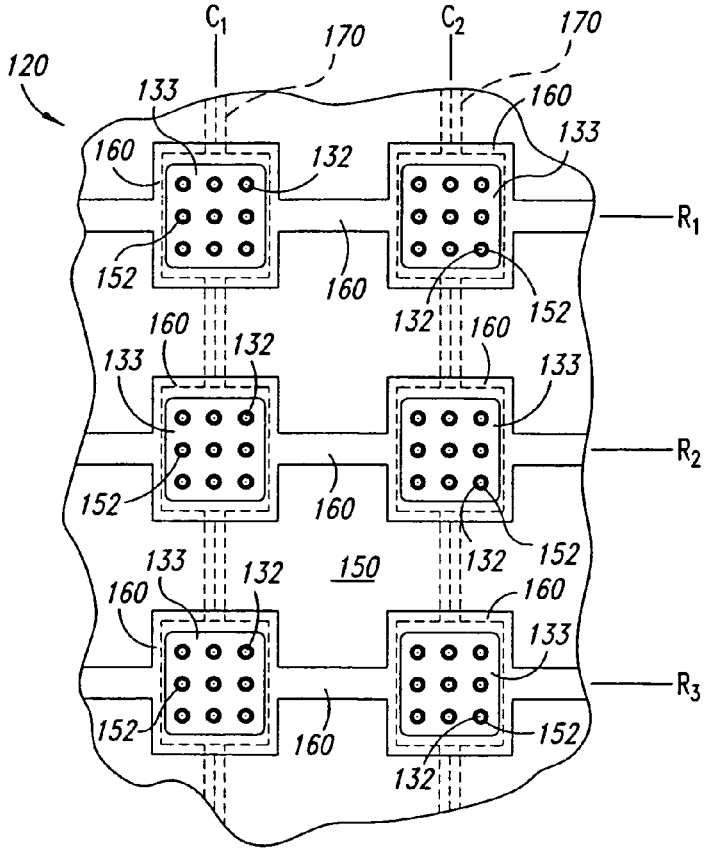
Fig. 3 (Prior Art)
FIG. 3 is a schematic top plan view of the base plate of the field emission display of FIG. 2.
Figure 4:
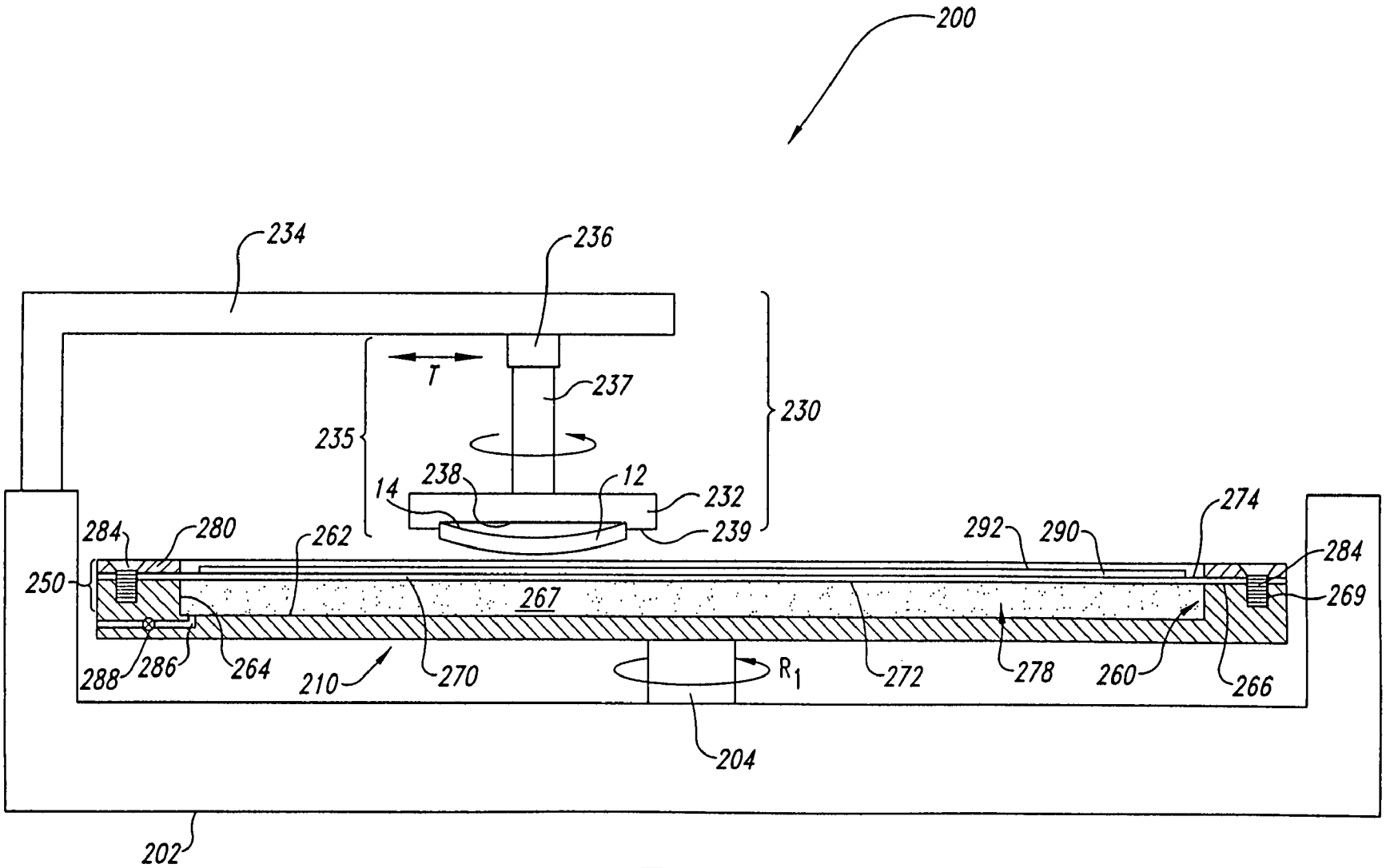
FIG. 4 is a schematic cross-sectional view illustrating a planarizing machine in accordance with an embodiment of the invention.

FIG. 4 is a schematic cross-sectional view of a planarizing machine 200 and a pad support assembly 250 in accordance with one embodiment of the invention for planarizing a substrate 12 on a planarizing medium 290. In the embodiment shown in FIG. 4, the substrate 12 has a convex "bow" such that the center of the substrate 12 has a downward curvature. The features and advantages of the pad support assembly 250 are best understood in the context of the structure and operation of the planarizing machine 200. Thus, the general features of the planarizing machine 200 will be described initially.

The planarizing machine 200 can have a housing 202, an actuator 204 attached to the housing 202, and a platen or table 210 coupled to the actuator 204. The table 210 is generally a rigid panel or plate, and the actuator 204 rotates the table 210 (arrow $R_1$) or otherwise moves the table 210 (not shown).

The planarizing machine 200 also has a carrier assembly 230 to hold and control the motion of the substrate 12. In one embodiment, the carrier assembly 230 has a substrate holder 232 to pick up, hold and release the substrate 12 at appropriate stages of the planarizing process. The carrier assembly 230 may also have an arm 234 carrying a drive assembly 235 that translates along the arm 234 (arrow T). The drive assembly 235 has an actuator 236 with a drive shaft 237 coupled to the substrate holder 232. The substrate holder 232 generally has a back surface 238 and a retaining ring 239 depending from the back surface 238.

In the general operation of the carrier assembly 230, the microelectronic substrate assembly 12 is mounted within the retaining ring 239 of the substrate holder 232. When the substrate 12 has a significant bow, a backside 14 of the substrate 12 is spaced apart from the back surface 238 of the substrate holder 232 such that the substrate 12 has a convex curvature with respect to the substrate holder 232. It will be appreciated that the curvature of the substrate 12 illustrated in FIG. 4 is greatly exaggerated for the purposes of illustration. In general, a twelve-inch or sixteen-inch substrate may have a bow of approximately 10–350 $\mu$m.

Figure 5:
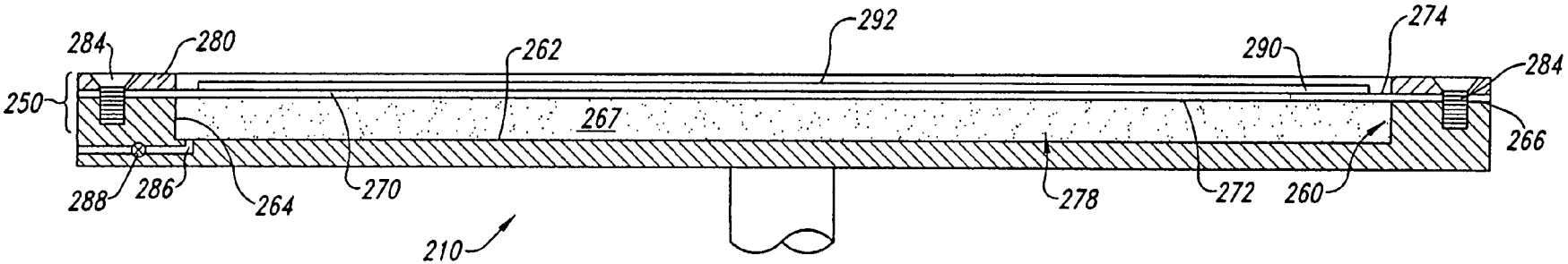
FIG. 5 is a detailed cross-sectional view illustrating an embodiment of a pad support assembly for use with the planarizing machine of FIG. 4.

FIG. 5 is a cross-sectional view illustrating one embodiment of the pad support assembly 250 on the table 210 in greater detail. Referring to FIGS. 4 and 5 together, the pad support assembly 250 generally has a fluid container 260 in the table 210 and an elastic membrane 270 coupled to the fluid container 260. The fluid container 260 can be a basin with a bottom section 262 and a sidewall 264 projecting from the bottom section 262. The sidewall 264 terminates at a rim 266 that contacts a perimeter portion of the elastic membrane 270. In the particular embodiment of the fluid container 260 shown in FIGS. 4 and 5, the bottom section 262 and the sidewall 264 are integral components of the table 210 such that the basin is defined by a depression in the table 210. As explained in more detail below, other embodiments of the fluid container can be individual components that are separately attached to the top of a flat table.

The elastic membrane 270 and the fluid container 260 define a cavity or fluid chamber 267 in the pad support assembly 250. The elastic membrane 270, more specifically, has a first surface 272 facing the cavity 267, and the membrane 270 has a second surface 274 facing away from the cavity 267. The elastic membrane 270 is preferably a non-perforated highly elastic sheet that can be stretched across the fluid chamber 267. The elastic membrane 270 is preferably stretched across the fluid chamber 267 to be fairly taut when a substrate is disengaged from the planarizing medium 290, and yet the elastic membrane 270 should have sufficient flexibility and resiliency to flex inward into the fluid chamber 267 when a substrate engages the planarizing medium 290. The membrane 270, for example, can be a non-perforated rubber sheet having a thickness of approximately 0.010–0.250 inches. The elastic membrane 270 may also be another type of suitable highly flexible, elastic sheet.

The first surface 272 of the membrane 270 is preferably sealed to the lip 266 of the fluid container 260 so that a support fluid 278 can fill the fluid chamber 267. The elastic membrane 270, for example, can be attached to the rim 266 of the fluid container 260 by a retaining member 280. In one embodiment, the retaining member 280 is a clamp-ring with a plurality of holes that receive a plurality of fasteners 284. The sidewall 264 of the fluid container 260 can accordingly have a plurality of corresponding holes 269 to receive a shaft portion of the fasteners 284. The fasteners 284 preferably threadably engage the holes 269 to clamp and seal a perimeter portion of the first surface 272 of the elastic member 270 to the lip 266 of the fluid container 260. Additionally, because the elastic membrane 270 is a non-perforated sheet and the retaining member 280 seals the membrane 270 to the rim 266, the support fluid 278 can be pressurized within the cavity 267. To pressurize the support fluid 278, the fluid container 260 preferably also includes a feed line 286 with a valve 288. The feed line 286 can be connected to a pressurized source (not shown) of support fluid 278 to fill the cavity 267 with the support fluid 278 at a desired pressure. The support fluid 278 is either water, glycerin, air or other suitable fluids.

The elastic membrane 270 supports the planarizing medium 290 on the second surface 274 of the membrane 270. The planarizing medium 290 can be a flexible, elastic polishing pad, or the planarizing medium 290 can be a combination of a polishing pad attached to an under-pad. When the planarizing medium 290 is solely a polishing pad, the polishing pad is preferably attached directly to the second surface 274 of the membrane 270. Similarly, when the planarizing medium 290 includes a polishing pad attached to an under-pad, the under-pad is preferably attached to the second surface 274 of the membrane 270. The planarizing medium 290 generally has a thickness of approximately 0.010–0.100 inches depending upon the type of polishing pad and the amount of wear. Suitable polishing pads that can be used for the planarizing medium are the IC-60, IC-1000, or Suba-4 manufactured by Rodel Corporation of Newark, Del. Other suitable polishing pads, however, can also be used.

Figure 6:
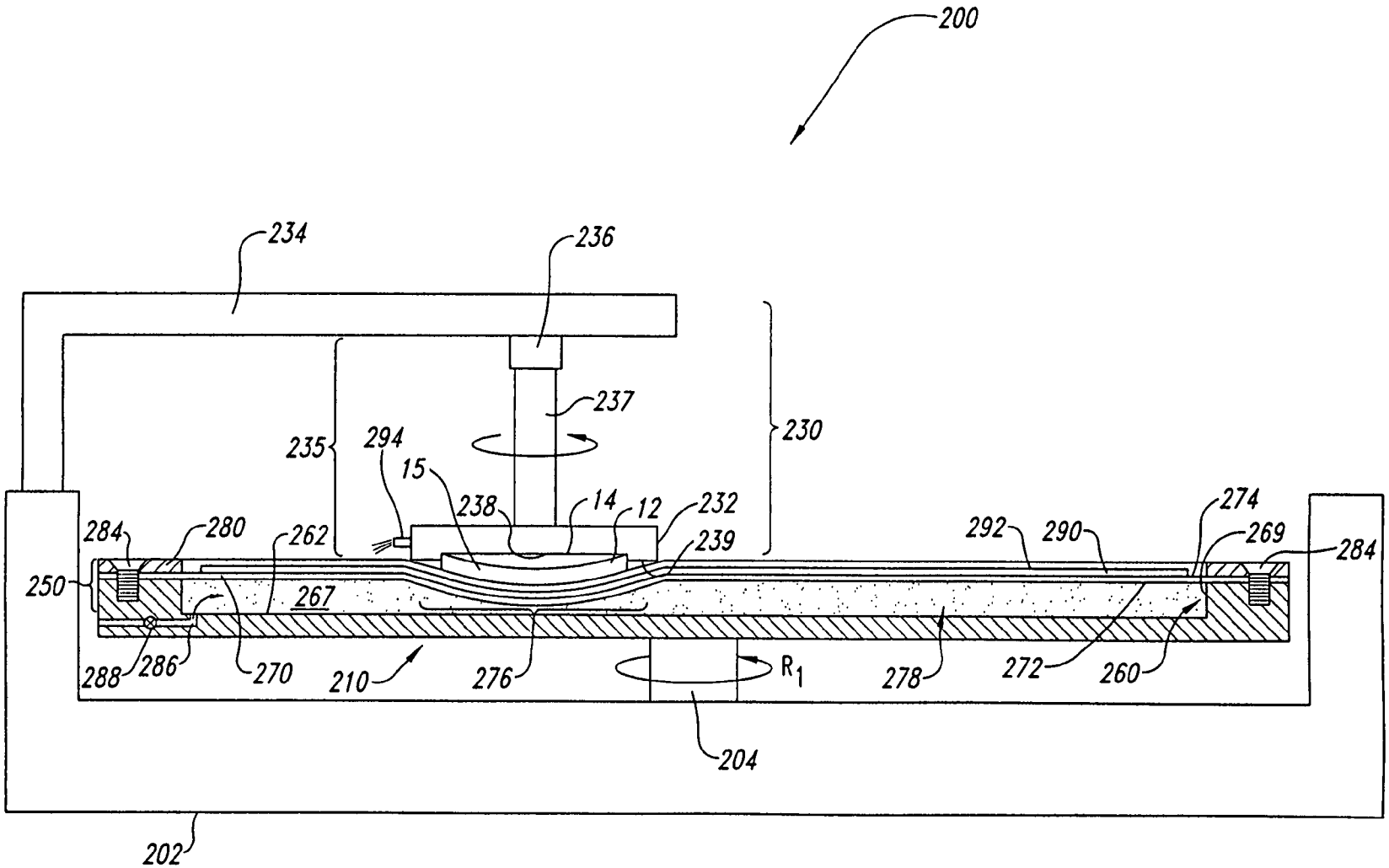
FIG. 6 is a schematic cross-sectional view illustrating an aspect of the operation of the planarizing machine of FIG. 4.

FIG. 6 is a schematic cross-sectional view illustrating one embodiment of a method for operating the planarizing machine 200 to planarize the substrate 12. The fluid chamber 267 of the fluid container 260 is initially filled with the support fluid 278 by opening the valve 288 and injecting the support fluid 278 through the feed line 286. The pressure of the support fluid 278 within the cavity 267 is preferably controlled to support the elastic membrane 270 and the planarizing medium 290 to be substantially planar. The pressure within the cavity 267, however, may be set so that the elastic membrane 270 and the planarizing medium 290 are either slightly convex or concave with respect to the bottom section 262 of the fluid container 260. Once the desired pressure of the support fluid 278 is achieved to configure the elastic membrane 270 and the planarizing medium 290 in a desired configuration, a front face 15 of the wafer 12 is planarized against the planarizing medium 290.

To planarize the wafer 12, the carrier assembly 230 moves the substrate holder 232 with respect to the planarizing medium 290 while pressing the front face 15 of the substrate 12 against the planarizing surface 292 of the planarizing medium 290. The carrier assembly 230 may also rotate the substrate holder 232 to spin the wafer 12, and the actuator 204 may rotate the table 210. As the carrier assembly 230 presses the substrate 12 against the planarizing surface 292, the planarizing medium 290 and the elastic membrane 270 flex together in a local flex zone 276 under the substrate 12. The local flex zone 276 is accordingly defined by the portion of the elastic membrane 270 and the planarizing medium 290 under the substrate 12 at any given moment during the planarizing process. The elastic membrane 270 and the planarizing medium 290 flex in the local flex zone 276 to conform to the global curvature of the substrate 12. Additionally, because the membrane 270 is elastic, the areas of the membrane 270 and the planarizing medium 290 that are not proximate to the substrate 12 return to an original elevation and curvature with respect to the bottom section 262 of the fluid container 260. The pressure of the support fluid 278 and the tension of the membrane 270, therefore, control the extent of flexion in the local flex zone 276 so that the planarizing surface 292 at least substantially conforms to the curvature of the front face 15 of the substrate 12.

The planarizing machine 200 illustrated in FIGS. 4–6 is expected to enhance the planarity of a planarized surface on a substrate with a curved or bowed front face. As described above with respect to the background of the invention section, conventional planarizing processes tend to over-polish the center region of a bowed substrate. For example, even conventional processes that use compressible polishing pads and backing pads on a rigid or otherwise inflexible support surface will often over polish the center region of a bowed substrate because the polishing pad and the backing pad cannot compress enough to conform to the large extent of curvature of a large substrate. Conventional planarizing techniques with compressible pads supported by rigid or non-flexible support surfaces, therefore, apply much higher pressures to the central region of a large substrate than the perimeter regions because the pads are not sufficiently compressible to readily conform to the curvature of such large substrates. Unlike conventional processes, the embodiment of the pad support assembly 250 provides an elastic membrane 270 and a pressurized support fluid 278 to support the planarizing medium 290 in a manner that allows the planarizing medium 290 to readily flex in a local flex zone 276. By flexing the planarizing medium 290 and the elastic membrane 270 together to form the local flex zone 276 under the substrate 12, the planarizing surface 292 continually conforms to the curvature of the front face 15 of the substrate 12. The pad support assembly 250 is accordingly expected to provide a relatively uniform pressure distribution between the front face 15 of the substrate 12 and the planarizing surface 292. Thus, compared to conventional systems that do not allow the planarizing medium 290 to readily flex under the influence of the substrate 12, the planarizing machine 200 is expected to reduce over polishing in the center regions of large substrates.

Figure 7:
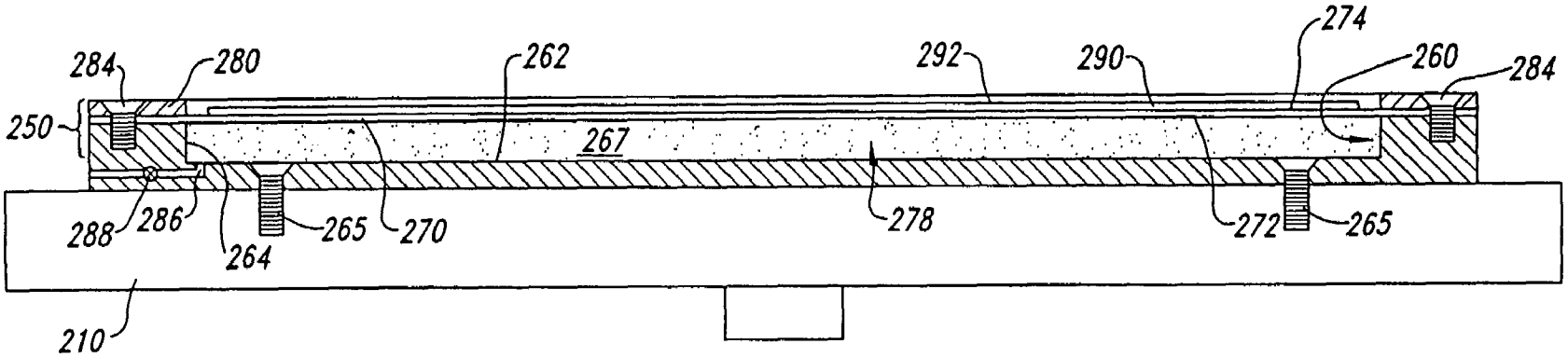
FIG. 7 is a detailed cross-sectional view illustrating another embodiment of a pad support assembly for use with the planarizing machine of FIG. 4.

FIG. 7 is a side cross-sectional view illustrating another embodiment of the pad support assembly 250 for use with the planarizing machine 200. In this embodiment, the fluid container 260 is an independent component with a basin having a bottom section 262 and a sidewall 264 that are separate from the table 210. Accordingly, the bottom section 262 of the fluid container 260 is attached to the table 210 with a plurality of fasteners 265, adhesives (not shown) or other suitable techniques. This embodiment of the pad support assembly 250 in FIG. 7 is particularly well suited for retrofitting existing platen-type planarization machines to planarize large microelectronic substrates or other substrates that are subject to having large curvatures. Additionally, the embodiment of the pad support assembly 250 illustrated in FIG. 7 also provides a great deal of flexibility because the pad support assembly 250 can be removed from the table 210 to provide a rigid support surface for conventional planarizing processes. Thus, a single planarizing machine can be configured to planarize a substrate with a large curvature by attaching the pad support assembly 250 to the table 210, or the planarizing machine can be configured to planarize a relatively flat substrate by removing the pad support assembly 250 from the table and attaching the planarizing medium 290 directly to the table 210.

Figure 8:
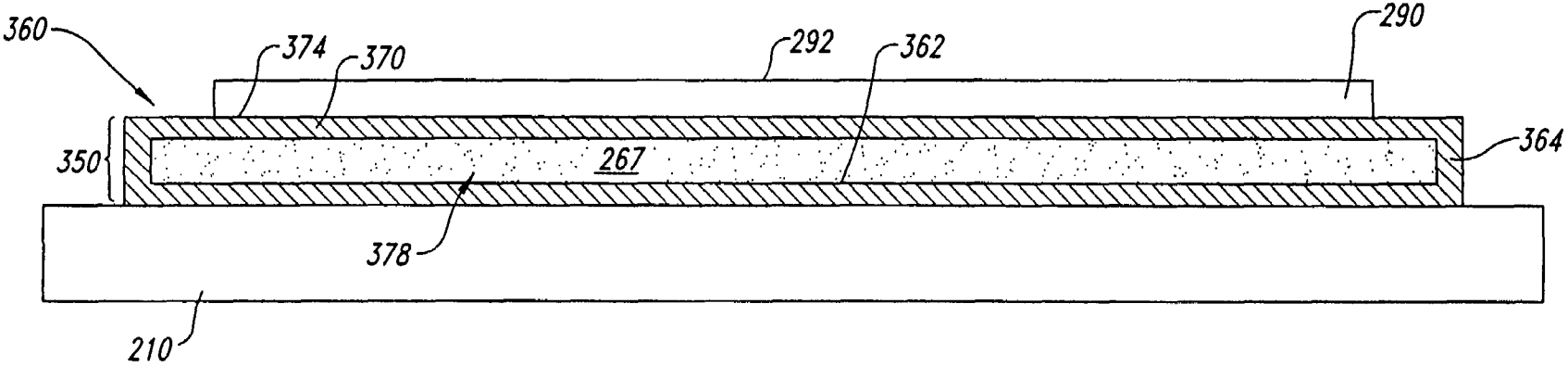
FIG. 8 is a schematic cross-sectional view partially illustrating still another embodiment of a pad support assembly in accordance with another embodiment of the invention.

FIG. 8 is a cross-sectional view illustrating another embodiment of a pad support assembly 350 on a flat table 210 for use in connection with a planarizing machine. In this embodiment, the pad support assembly 350 has a fluid container 360 and an elastic membrane 370 that together define an enclosed bladder. For example, the fluid container 360 can have a bottom section 362 and a sidewall 364 projecting from the bottom section 362. The elastic membrane 370 is either formed integrally with the sidewall 364, or the membrane 370 is attached to the sidewall 364 to define a fluid chamber 367. In one embodiment, for example, the bottom section 362, the sidewall 364 and the elastic membrane 370 are formed integrally from rubber or another flexible material. The elastic membrane 370 is preferably much thinner than the bottom section 362 and the sidewall 364 such that the elastic membrane 370 is highly flexible, and yet the bottom section 362 and the sidewall 364 are fairly rigid. The cavity 367 is preferably filled with a support fluid 378 that can be injected into the cavity 367 with a needle or a valve.

The pad support assembly 350 is attached to the table 210, and the planarizing medium 290 is attached to the pad support assembly 350. More specifically, the bottom section 362 of the pad support assembly 350 is adhered or otherwise attached to the table 210, and the planarizing medium 290 is adhered or otherwise attached to an exterior surface 374 of the elastic membrane 370. In operation, a carrier assembly (not shown in FIG. 8) presses a substrate (not shown in FIG. 8) against the planarizing surface 292 of the planarizing medium 290 to remove material from the substrate. The elastic membrane 370 and the planarizing medium 290 accordingly flex under the influence of the substrate in a manner similar to that described above with respect to the pad support assembly 250 shown in FIGS. 4–6. Accordingly, the elastic membrane 370 and the planarizing medium 290 are expected to conform to the curvature of the substrate during planarization to provide a uniform distribution of pressure between the front face of the substrate and the planarizing surface 292 of the planarizing medium 290.

Figure 9:
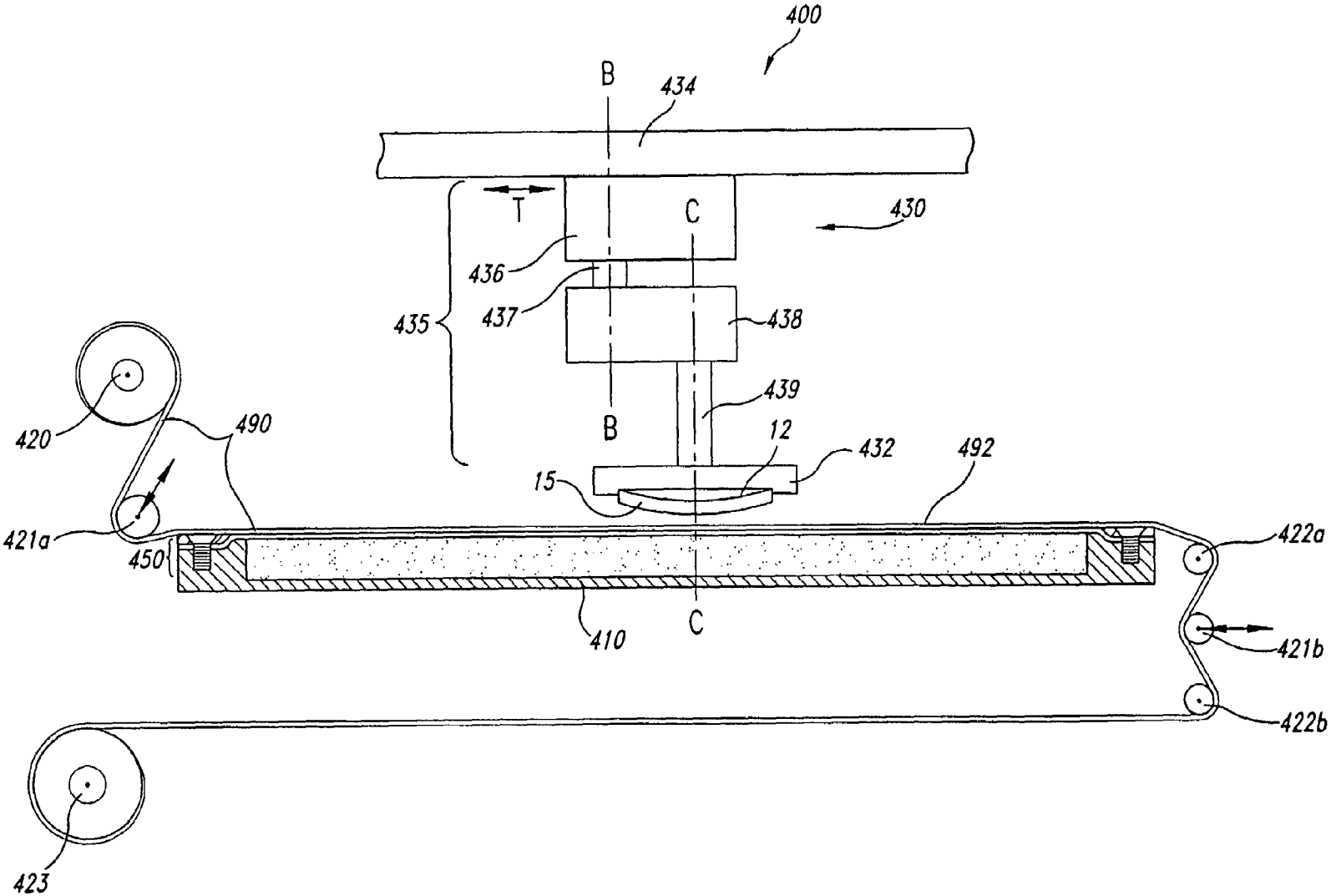
FIG. 9 is a schematic cross-sectional view of another planarizing machine in accordance with another embodiment of the present invention.

FIG. 9 is a schematic side elevational view of another planarizing machine 400 with another pad support assembly 450 in accordance with still another embodiment of the invention for planarizing the substrate 12. The planarizing machine 400 generally has a support table 410 and a pad support assembly 450 to flexibly support an operative portion of a web-format planarizing medium 490. Unlike platen-type planarizing machines with circular, rotating tables (e.g., table 210 in FIG. 4), the support table 410 for the web-format planarizing machine 400 is preferably a rectilinear, stationary table.

The planarizing machine 400 also has a plurality of rollers to guide, position and hold the operative portion of the planarizing medium 490 over the pad support assembly 450. In one embodiment, the rollers include a supply roller 420, first and second idler rollers 421*a* and 421*b*, first and second guide rollers 422*a* and 422*b*, and a take-up roller 423. The supply roller 420 carries an unused or pre-operative portion of the planarizing medium 490, and the take-up roller 423 carries a used or post-operative portion of the planarizing medium 490. A motor (not shown) drives at least one of the supply roller 420 and the take-up roller 423 to sequentially advance the processing medium 490 across the pad support assembly 450. As such, unused portions of the planarizing medium 490 may be quickly substituted for worn sections to provide a consistent surface for planarizing and/or cleaning the substrate 12. Moreover, the first idler roller 421*a* and the first guide roller 422*a* stretch the web-format planarizing medium 490 over the pad support assembly 450 to hold the planarizing medium 490 stationary during planarization.

The planarizing machine 400 also has a carrier assembly 430 to translate the substrate 12 across the planarizing medium 490. In one embodiment, the carrier assembly 430 has a substrate holder 432 to pick up, hold and release the substrate 12 at appropriate stages of the planarizing and finishing cycles. The carrier assembly 430 may also have a support gantry 434 carrying a drive assembly 435 that translates along the gantry 434 (arrow T). The drive assembly 435 generally has an actuator 436, a drive shaft 437 coupled to the actuator 436, and an arm 438 projecting from the drive shaft 437. The arm 438 carries the substrate holder 432 via another shaft 439. In another embodiment, the drive assembly 435 may also have another actuator (not shown) to rotate the substrate holder 432 about an axis C—C as the actuator 436 orbits the substrate holder 432 about an axis B—B. One suitable planarizing machine without the pad support assembly 450 is manufactured by EDC Corporation.

Figure 10:
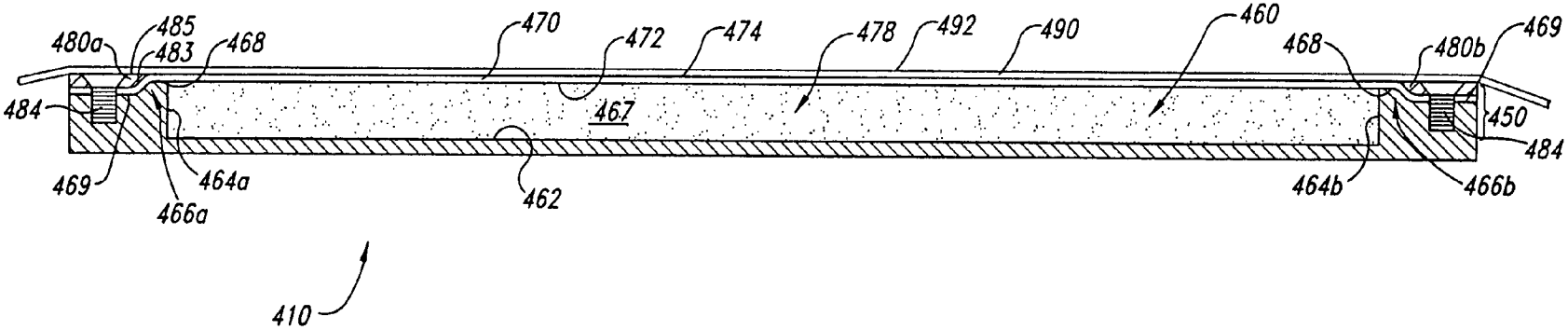
FIG. 10 is a detailed cross-sectional view partially illustrating an embodiment of a pad support assembly for use with the planarizing machine of FIG. 9.

FIG. 10 is a detailed view of the embodiment of the pad support assembly 450 for supporting the web-format planarizing medium 490 in the planarizing machine 400. In this embodiment, the pad support assembly 450 has fluid container 460 with a bottom section 462, a first sidewall 464*a* projecting from one side of the bottom section 462, and a second sidewall 464*b* projecting from an opposing side of the bottom section 462. The sidewalls 464*a* and 464*b* each terminate at a lip 466 that has an upper surface 468 and a depression 469.

The pad support assembly 450 also has an elastic membrane 470 with an interior surface 472 facing the bottom section 462 to define a cavity or fluid chamber 467. The elastic membrane 470 also has an exterior surface 474 to support the operating portion of the planarizing medium 490. The elastic membrane 470 is generally clamped to the first and second sidewalls 464*a* and 464*b* by first and second retaining members 480*a* and 480*b*, respectively. The retaining members 480*a* and 480*b* each preferably have a lower surface 483 configured to correspond to the depression 469 in the lip 466 of the sidewalls 464*a* and 464*b*. The retaining members 480*a* and 480*b* can be attached to the sidewalls 466 by a plurality of fasteners 484 to clamp the elastic membrane 470 to the fluid container 460 in a manner that seals the fluid chamber 467. The depressions 469 in the lips 466 preferably receive the retaining members 480*a* and 480*b* so that the exterior surface 474 of the elastic membrane 470 and an upper surface 485 of each retaining member 480*a* and 480*b* are at least substantially coplanar. The pad support assembly 450 accordingly has a flat surface for supporting the planarizing medium 490.

In operation, the fluid chamber 467 is filled with a support fluid 478 to further support the elastic membrane 470. Referring to FIG. 9, the carrier assembly 430 moves the substrate holder 432 so that the front face 15 of the substrate 12 presses against a planarizing surface 492 of the web-format planarizing medium 490. The portion of the web-format planarizing medium 490 and the elastic membrane 470 flex in a local flex zone (not shown in FIG. 9) underneath the substrate 12 in a manner similar to that described above with reference to the planarizing machine 200 illustrated in FIGS. 4–6. Additionally, because the pad support assembly 450 has a flat surface, the planarizing medium 490 can be advanced across the pad support assembly 450 without disruption to provide a clean segment of the planarizing medium 490 over the pad supporting assembly 450. The planarizing machine 400, accordingly, is expected to provide substantially similar results and advantages as the planarizing machine 200, along with the additional advantages of web-format planarizing machines.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A planarizing machine for processing microelectronic substrate assemblies, comprising:

a table;

a fluid container removably attached to the table, the fluid container is a bladder having a bottom section attached to the table, a sidewall projecting from the bottom section, and an elastic membrane, the elastic membrane being a top portion of the bladder integral with the sidewall, the bottom section and the sidewall having thicknesses greater than a thickness of the elastic membrane to define an at least semi-rigid support for the elastic membrane; the bottom section, the sidewall, and the elastic membrane defining an enclosed fluid chamber in the bladder.

2. The planarizing machine of claim 1 wherein the elastic membrane of the bladder is a rubber sheet.

3. The planarizing machine of claim 2, further comprising a support fluid in the fluid chamber to support the elastic membrane.

4. The planarizing machine of claim 3 wherein the support fluid comprises liquid water.

5. The planarizing machine of claim 3 wherein the support fluid comprises glycerin.

6. The planarizing machine of claim 3 wherein the support fluid comprises air.

7. The planarizing machine of claim 1 wherein the bladder comprises a uniformly resilient elastomeric material.

8. The planarizing machine of claim 1 wherein the elastic membrane is a non-perforated elastic membrane.

9. A planarizing machine for planarizing microelectronic substrates, comprising:

a table;

a fluid container removably attached to the table, the fluid container comprising a bladder including a bottom section having a first thickness attached to the table and a sidewall having a second thickness projecting from the bottom section, and an elastic membrane, the elastic membrane having a thickness less than the first thickness and the second thickness; the bottom section and the sidewall defining an at least semi-rigid support for the membrane; the elastic membrane being attached to the sidewall to define a fluid chamber in the bladder in a space between the bottom section and the elastic membrane.

10. The planarizing machine of claim 9, further comprising a support fluid in the fluid chamber, wherein the support fluid comprises liquid water.

11. The planarizing machine of claim 9, further comprising a support fluid in the fluid chamber, wherein the support fluid comprises glycerin.

12. The planarizing machine of claim 9, further comprising a support fluid in the fluid chamber, wherein the support fluid comprises air.

13. The planarizing machine of claim 9 wherein the bladder comprises a resilient elastomeric material.

14. The planarizing machine of claim 9 wherein the elastic membrane is a non-perforated elastic membrane.

15. A planarizing apparatus for use in a planarizing machine for microelectronic devices, comprising:

a pad support assembly having a bottom section of a first thickness, the bottom section configured to be attached to a table of the planarizing machine, a sidewall having a second thickness projecting from the bottom section, an elastic membrane having a thickness less than the first thickness and the second thickness; the bottom section and the sidewall defining an at least semi-rigid support for the membrane; the elastic membrane being coupled to the sidewall to define an enclosed fluid chamber, the bottom section, the sidewall and the elastic membrane being an integral component defining a bladder;

a support fluid in the fluid chamber; and a planarizing medium coupled to the elastic membrane, the planarizing medium and the elastic membrane configured to flex in a local flex zone under a substrate pressed against the planarizing medium to provide at least a substantially uniform pressure distribution across the substrate.

16. The planarizing apparatus of claim 15 wherein the support fluid comprises water.

17. The planarizing apparatus of claim 15 wherein the support fluid comprises glycerin.

18. The planarizing apparatus of claim 15 wherein the support fluid comprises air.

19. The planarizing machine of claim 15 wherein the pad support assembly comprises a elastomeric material.

20. The planarizing machine of claim 15 wherein the elastic membrane is a non-perforated elastic membrane.

* * * * *